United States Patent [19]

Closmann et al.

[11] 3,945,679

[45] Mar. 23, 1976

[54] SUBTERRANEAN OIL SHALE PYROLYSIS WITH PERMEATING AND CONSOLIDATING STEPS

[75] Inventors: Philip J. Closmann; Gary Drinkard; Evan H. Street; Charles C. Templeton; Min Jack Tham, all of Houston, Tex.

[73] Assignee: Shell Oil Company, Houston, Tex.

[22] Filed: Mar. 3, 1975

[21] Appl. No.: 554,853

[52] U.S. Cl. ..... 299/5; 166/271; 166/272; 166/259; 166/281

[51] Int. Cl.[2] ..... E21B 43/24

[58] Field of Search ..... 166/259, 256, 260, 261, 166/272, 303, 281, 271, 276, 292–295; 199/3–5

[56] References Cited

UNITED STATES PATENTS

| | | | |
|---|---|---|---|
| 2,771,952 | 11/1956 | Simm | 166/288 X |
| 3,292,701 | 12/1966 | Goodwin et al. | 166/288 X |
| 3,409,079 | 11/1968 | Burtch | 166/288 |
| 3,513,913 | 5/1970 | Bruist | 166/259 X |
| 3,537,528 | 11/1970 | Herce et al. | 166/259 X |
| 3,565,171 | 2/1971 | Closmann | 166/256 X |

*Primary Examiner*—Stephen J. Novosad

[57] ABSTRACT

In producing shale oil by circulating hot fluid into and out of a rubble-containing cavern within a subterranean oil shale, plugging is avoided by permeating a portion of oil shale, consolidating a permeated portion, inflowing fluid outside the consolidated portion, and outflowing fluid from within the consolidated portion so the fluid is filtered through the consolidated portion.

4 Claims, 1 Drawing Figure

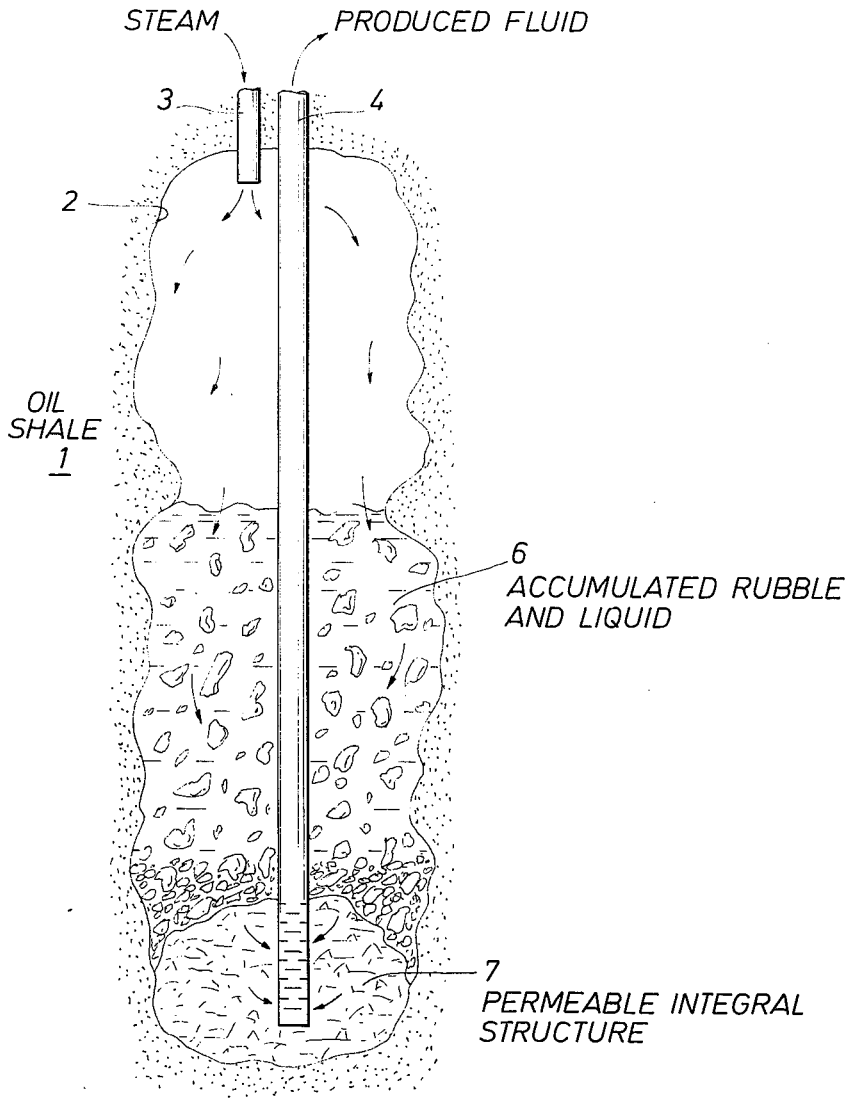
STEAM
PRODUCED FLUID
3
4
2
OIL
SHALE
1
6
ACCUMULATED RUBBLE
AND LIQUID
7
PERMEABLE INTEGRAL
STRUCTURE

SUBTERRANEAN OIL SHALE PYROLYSIS WITH PERMEATING AND CONSOLIDATING STEPS

BACKGROUND OF THE INVENTION

The invention relates to producing shale oil and related mineral materials from subterranean deposits of oil shale.

Numerous subterranean oil shales are mixed with water-soluble minerals and comprise substantially impermeable, kerogen-containing, earth formations from which shale oil can be produced by a hot fluid-induced pyrolysis or thermal conversion of the organic solids to fluids. A series of patents typified by the T. N. Beard, A. M. Papadopoulos and R. C. Ueber U.S. Pat. Nos. 3,739,851; 3,741,306; 3,753,594; 3,759,328; and 3,759,574 describe procedures for utilizing the water-soluble minerals to form rubble-containing caverns in which the oil shale is exposed to a circulating hot aqueous fluid that converts the kerogen to shale oil while dissolving enough solid material to expand the cavern and expose additional oil shale. In such processes, the heat transfer is aided by injecting the hot fluid into an upper portion and withdrawing fluid from a lower portion of the cavern.

However, as described in the P. J. Closmann and G. O. Suman U.S. Pat. Nos. 3,804,169 and 3,804,172, such prior cavern-utilizing processes are subject to a tendency for the flow paths to become plugged. The hot aqueous fluid flowing down along the walls of the cavern rubbles and disaggregates portions of the shale oil into particles having sizes ranging from a few microns to several feet in diameter. The particles tend to slump or to flow as a turbidity current down the walls of the cavern and pile up around the fluid withdrawal point near the bottom of the cavern. In the U.S. Pat. No. 3,804,169, a pattern of fracture-interconnected caverns and wells are arranged so that fluid injected near the top of one well is produced through a plurality of surrounding wells with the flow rates being too low to carry the solids to the production wells. In the U.S. Pat. No. 3,804,172, the lower portion of such a cavern is packed with a mass of large rigid solid particles, so that the slurried solids in the slumping turbidity currents are spread over large surface areas while the fluids are flowing through the relatively large openings that exist between the particles.

In the process of patent application Ser. No. 489,639, filed July 18, 1974 by M. J. Tham and P. J. Closmann, now U.S. Pat. No. 3,880,238, a hot solvent-fluid (which is significantly miscible with at least one organic or inorganic solid or liquid pyrolysis product of the oil shale) is injected into an upper portion of a rubble-containing cavern in a subterranean oil shale. A non-solvent gas (which has a relatively insignificant miscibility with any of said pyrolysis products) is also injected into an upper portion of the cavern. Fluid is withdrawn from the cavern from below the points of fluid injection. And, the properties and flow rates of the injected and produced fluids are correlated so that the cavern remains sufficiently liquid-free to prevent a significant plugging of the fluid flow path.

SUMMARY OF THE INVENTION

This invention relates to producing shale oil by circulating hot fluid into and out of a rubble-containing cavern or cavity within a subterranean oil shale formation. A portion of oil shale in and around the cavity is converted to a permeable rubble. At least a portion of the rubble is consolidated into a substantially integral permeable structure. Hot fluid is flowed into the cavity at a location outside the permeable structure. And, fluid is flowed out of the cavity from within the permeable structure so that the outflowing fluid is filtered through the permeable structure.

DESCRIPTION OF THE DRAWING

The drawing is a schematic illustration of a portion of a well which extends into a subterranean oil shale formation and is being used in the present process.

DESCRIPTION OF THE INVENTION

The present invention is, at least in part, premised on the following discovery. A portion of a subterranean oil shale can be permeated and then consolidated to form a permeable structure capable of filtering fluid circulated through it. In a process for producing shale oil by circulating hot fluid into and out of a rubble-containing cavern, such a permeation and consolidation of oil shale can avoid the plugging of the flow path of a downflowing fluid. Those steps avoid a need for reducing the rate of shale oil recovery rate to reduce the rate of fines production, for example by circulating only a non-solvent gas to pyrolize the oil shale while forming less fines. They avoid using only a bottom in - top out fluid flow to suspend the particles of disaggregated oil shale. They also reduce the expense and delay of (a) fluid-mining a bottom-located void and then packing it with boulders or (b) forming a pattern of fracture-interconnected caverns and wells to utilize a radially expanding pattern of fluid outflow. And, they also reduce the expense of arranging and monitoring circulations of both solvent and non-solvent fluids to keep the cavern substantially free of liquid.

As used herein "oil shale" refers to a substantially impermeable aggregation of inorganic solids and a predominately hydrocarbon-solvent-insoluble organic solid material known as "kerogen". "Bitumen" refers to the hydrocarbon-solvent-soluble organic material that may be initially present in an oil shale or may be formed by a thermal conversion or pyrolysis of kerogen. "Shale oil" refers to gaseous and/or liquid hydrocarbon materials (which may contain trace amounts of nitrogen, sulfur, oxygen, or the like) that can be obtained by distilling or pyrolyzing or extracting organic materials from an oil shale. "Water-soluble inorganic mineral" refers to halites or carbonates, such as the alkali metal chlorides, bicarbonates or carbonates, which compounds or minerals exhibit a significant solubility (e.g., at least about 10 grams per 100 grams of solvent) in generally neutral aqueous liquids (e.g., those having a pH of from about 5 to 8) and/or heat-sensitive compounds or minerals, such as nahcolite, dawsonite, trona, or the like, which are naturally water-soluble or are thermally converted at relatively mild temperatures (e.g., 500° to 700°F) to materials which are water-soluble. The term "water-soluble-mineral-containing subterranean oil shale" refers to an oil shale that contains or is mixed with at least one water-soluble inorganic mineral, in the form of lenses, layers, nodules, finely-divided dispersed particles, or the like. A "cavern" or "cavity" (within an oil shale formation) refers to a relatively solids-free opening or void in which the solids content is less than about 60% (preferably less than about 50%) and substantially all of the solids are pieces which are substantially completely surrounded by fluid and are relatively movable, as compared to fracture-propping particles.

A hot solvent-fluid suitable for use in the present process is one which is heated to a temperature of about 500° to 700°F and, at such a temperature, exhibits a significant miscibility with at least one of the organic or inorganic solid or liquid pyrolysis products of a water-soluble-mineral-containing oil shale. Such fluids preferably contain, or consist essentially of steam at a temperature and pressure causing condensation within the cavern. Such fluids may also include or comprise hydrocarbons such as benzene, toluene, shale oil hydrocarbons, oil-soluble gases such as carbon dioxide, mixtures of such fluids, and the like.

As shown in the drawing, the present invention can be practiced with a relatively simple arrangement of downhole equipment. A subterranean oil shale formation (1) is penetrated by a well borehole (2). The oil shale formation is preferably, but not necessarily, a water-soluble-mineral-containing oil shale. In the stage shown, the dimensions of the borehole (2) have been expanded into a relatively large cavity. An inflow conduit (3) is arranged to terminate near the top of the cavity. And, an outflow conduit (4) is arranged to have a perforated lower end near the bottom of the cavity.

The drawing shows steam being inflowed into the upper portion of the cavity through conduit (3) while fluid is being withdrawn near the bottom of the cavity through conduit (4). As the steam contacts the oil shale along the cavity wall it cools and condenses to form a column (6) of accumulated rubble and liquid. The fluid being outflowed from the cavity is withdrawn from within a permeable integral structure (7) through which the outflowing fluid is filtered.

The permeable integral structure (7) can readily be formed, by permeating a portion of the oil shale or the adjacent rock, e.g., by means of known fracturing and/or leaching or acidizing techniques, and consolidating the permeable mass, e.g., by a consolidating procedure of the type used to consolidate a sand or gravel. For example, in forming the permeable mass a portion of the borehole can be underreamed, filled with explosive (such as a pumpable liquid explosive) and explosively opened into communication with the fracture-permeated mass of rubble. Such a rock permeating technique can be supplemented or replaced by a means of conventional hydraulic fracturing, and/or selective solution-mining of layers or nodules of water-soluble mineral such as nahcolite, and/or a selective acidization of the most acid-soluble components of inhomogeneous formation, or like procedures for forming a permeable mass of rocks. As will be apparent to those skilled in the art, the permeable mass of rubble can be formed entirely within the subterranean oil shale formation or can be formed substantially entirely within an underlying earth formation, as long as a significant portion of the permeable mass is in fluid communication with an overlying portion of subterranean oil shale.

The following is a particularly suitable procedure for forming a permeable mass and then consolidating it into a substantially integral permeable structure. A borehole is drilled to near the bottom of a subterranean oil shale formation. It is drilled or underreamed to have a diameter (such as from 2 to 4 feet) providing a passageway for the free circulation of fluid around the conduits within the borehole. A portion of the oil shale around the bottom of the borehole is rubbled by fracturing and/or leaching. The rubble is then consolidated by hot gas-carbonization of its organic components. Such a gas can be heated at a surface location and circulated through the borehole and rubble in the direction shown by the arrows. Alternatively (and preferably), an underground combustion can be initiated (near the top or the bottom of the rubble) and the combustion front can be advanced through the rubble. In such a procedure, a readily oxidizable fuel (such as linseed oil) can be injected and then exothermically oxidized by injecting an oxidizing agent such as hydrogen peroxide, nitric acid, or the like. The oxidation reaction can heat the injected and/or naturally-occurring hydrocarbon to a combustion temperature. After combustion temperature has been reached, a combustion front can be advanced through the mass of rubble by circulating air or an oxygen-containing gas through the rubble (in either an upward or downward direction). Alternatively, steam or other hot gas can be inflowed to aid or accomplish the initial heating. The combustion is advanced through the rubble until a relatively large zone is converted to a permeable integral structure. The permeable structure should be large enough to surround the opening into a conduit from which fluid is to be outflowed from the cavity. The structure is preferably generally cylindrical and at least about 10 to 50 feet in height and radius.

A hot gas-effected carbonization of an oil shale rubble is advantageous. It causes a significant amount of the oil shale kerogen to be pyrolyzed to shale oil hydrocarbon vapors (which can be recovered) while other portions of the organic components of the oil shale are being carbonized. The carbonization bonds the pieces of rock into an integral permeable structure.

Alternatively, a permeable mass of rubble can be consolidated by treating it with an intergranular cement-forming sand consolidating fluid. The treatment can employ one or more fluids that comprise or interact to form organic or inorganic intergranular cements such as resins, silicates, hydrated oxide or the like that bind the grains together. The sand consolidating fluid is preferably one that forms relatively heat-stable bonds between the pieces of rock. Particlarly suitable sand consolidation techniques include the various processes of injecting at least one self-precipitating solution, or a sequence of slugs of interacting solutions, which deposit grain-bonding materials such as silicates, hydroxy-aluminates, or effect an electrolless metal plating on the rock granules, or the like.

After forming a permeable integral structure capable of functioning as a relatively massive filter around a fluid withdrawal point near the bottom of the cavity, the oil shale pyrolysis can advantageously be conducted by a downflow process of circulating a hot solvent fluid, preferably an aqueous fluid (such as steam), as shown in the drawing. The filtration removes the oil shale solids that tend to be transported by the circulating fluid. The injection pressure required to maintain a selected rate of flow and/or the rate of flow maintained by a constant pressure, is preferably monitored (continuously or intermittently). As the filter (i.e., the permeable integral structure) becomes plugged the injection pressure will be increased or the flow rate will be decreased. Too large an increase in the injection pressure creates a danger of fracturing the subterranean oil shale and propagating a fracture into an undesirable location, such as a surface location. When the injection pressure required to maintain a selected rate of flow has increased by a selected amount (or when the flow rate established by a selected injection pressure has been decreased by a selected amount) due to the plugging of the permeable structure, the direction of the fluid flow is preferably temporarily reversed in order to backwash and clean-out its pores.

It should be noted that during a backflow process of circulating fluids in through a substantially integral permeable structure near the bottom of the cavity and out near the top of the cavity, the bottom-located permeable structure tends to act as a sparger or filter disk for increasing the horizontal area over which the inflowing fluids are distributed within the cavity. The advantages of such a relatively widely distributed upflow are more completely described in a copending patent application by M. J. Tham and P. J. Closmann, Ser. No. 476,973, filed June 6, 1974. That application describes an improvement in the previously proposed types of subterranean cavity-confined shale oil recovery processes that use an upflow circulation of fluid. The improvement is effected by radially extending the region of current upflow, for example by positioning large inert objects in a radially extensive layer above the point of fluid injection.

In the backflow step of the present process, the integral permeable structure tends to radially extend the region of current upflow. The upper portion receives most of the screened-out lumps and fine particles of oil shale solids. Such a layered plugging reduces the vertical permeability and increases the horizontal flow through the integral permeable structure. Thus, in the present process the backflushing is preferably continued for a significant time, such as 1–10 days, and can produce a significant amount of shale oil.

What is claimed is:

1. In a process for producing shale oil by circulating hot fluid into and out of a rubble-containing cavern within a subterranean oil shale formation, the improvement comprising:

forming a permeable mass of rubble in and around a portion of the cavern;

consolidating a portion of said rubble into a substantially integral permeable structure by treating it with an intragranular cementforming sand consolidating fluid;

flowing hot fluid into the cavern at a location outside said permeable structure; and flowing fluid out of the cavern from within said permeable structure so that the outflowing fluid is filtered through that structure.

2. The process of claim 1 in which at least a portion of the outflowing fluid is liquid.

3. The process of claim 1 in which the oil shale formation is a water-soluble-mineral-containing formation and the circulated hot fluid is an aqueous fluid.

4. The process of claim 3 in which the permeable mass of rubble is formed by explosively fracturing a lower portion of the oil shale formation and leaching out portions of the water-soluble mineral.

* * * * *